US009073023B2

(12) United States Patent
Bernard et al.

(10) Patent No.: US 9,073,023 B2
(45) Date of Patent: Jul. 7, 2015

(54) MIXING IN A CONTAINER OF CONTENT HAVING A BASE COMPONENT AND A COMPONENT TO BE MIXED

(75) Inventors: Frederic Bernard, La Cadiere d'Azur (FR); Eric Chevalier, Paris (FR)

(73) Assignee: SARTORIUS STEDIM FMT SAS, Aubagne (FR)

( * ) Notice: Subject to any disclaimer, the term of this patent is extended or adjusted under 35 U.S.C. 154(b) by 1207 days.

(21) Appl. No.: 13/054,234

(22) PCT Filed: Jun. 16, 2009

(86) PCT No.: PCT/FR2009/051136

§ 371 (c)(1),
(2), (4) Date: Feb. 16, 2011

(87) PCT Pub. No.: WO2010/007273

PCT Pub. Date: Jan. 21, 2010

(65) Prior Publication Data

US 2011/0158037 A1 Jun. 30, 2011

(30) Foreign Application Priority Data

Jul. 16, 2008 (FR) ..... 08 54827

(51) Int. Cl.
*B01F 3/12* (2006.01)
*B01F 5/20* (2006.01)
(Continued)

(52) U.S. Cl.
CPC ..... *B01F 5/20* (2013.01); *B01F 3/1207* (2013.01); *B01F 3/1221* (2013.01); *B01F 7/162* (2013.01); *B01F 15/0085* (2013.01)

(58) Field of Classification Search
CPC ..... B01F 5/20; B01F 7/162; B01F 15/0085
USPC ..... 366/273–274, 348, 349, 314; 435/302.1; 383/127; 416/3; 206/219–221, 818; 215/DIG. 3, DIG. 8; 604/416, 903
See application file for complete search history.

(56) References Cited

U.S. PATENT DOCUMENTS 3,647,397 A * 3/1972 Coleman ..... 366/167.1
5,533,804 A * 7/1996 Larsson et al. ..... 366/274
(Continued)

FOREIGN PATENT DOCUMENTS

DE 1782124 A1 3/1971
EP 1842800 A2 10/2007
FR 2781202 A1 1/2000

OTHER PUBLICATIONS

International Search Report, dated Nov. 26, 2009, from corresponding PCT application.

*Primary Examiner* — Charles Cooley
(74) *Attorney, Agent, or Firm* — Young & Thompson

(57) ABSTRACT

A mixing process, a spraying and dispersing device, and a mixing device for implementing the process. In the process, components are introduced into a container equipped with introduction elements and mixing elements and the contents are mixed. A mixing facilitator is provided, a spraying and dispersing device that can be connected to the container at one of its introduction element is provided, able to be in an active functional state in which it makes it possible to spray and to disperse a liquid in the container, and then, in a first phase, the base of the contents and then the components to be mixed are introduced into the container, without filling the latter, and in a second phase, the mixing facilitator is introduced into the container via an introduction element, and it is sprayed and dispersed to the components to be mixed by the spraying and dispersing device that is put into the active functional state.

24 Claims, 7 Drawing Sheets

(51) Int. Cl.
*B01F 7/16* (2006.01)
*B01F 15/00* (2006.01)

(56) References Cited

U.S. PATENT DOCUMENTS 5,750,440 A * 5/1998 Vanell et al. ..... 438/692
5,803,137 A * 9/1998 Shimotoyodome et al. .... 141/67
5,941,635 A * 8/1999 Stewart ..... 366/165.5
5,988,422 A * 11/1999 Vallot ..... 220/62.22
6,844,186 B2 * 1/2005 Carll ..... 435/289.1
7,153,021 B2 * 12/2006 Goodwin et al. ..... 366/273
7,278,780 B2 * 10/2007 Goodwin et al. ..... 366/273
7,695,186 B2 * 4/2010 Terentiev ..... 366/279
7,832,922 B2 * 11/2010 Schoeb ..... 366/273
8,282,267 B2 * 10/2012 Castillo et al. ..... 366/262
8,292,491 B2 * 10/2012 Castillo et al. ..... 366/273
8,746,964 B2 * 6/2014 Castillo et al. ..... 366/273
8,845,182 B2 * 9/2014 Bernard et al. ..... 366/314
2004/0190372 A1 * 9/2004 Goodwin et al. ..... 366/273
2004/0245144 A1 * 12/2004 Hurst ..... 206/527
2005/0279687 A1 12/2005 Hsu
2006/0131765 A1 6/2006 Terentiev et al.
2006/0176772 A1 * 8/2006 Goodwin et al. ..... 366/273
2007/0253287 A1 * 11/2007 Myhrberg et al. ..... 366/273
2010/0220547 A1 * 9/2010 Bernard et al. ..... 366/150.1
2011/0013474 A1 * 1/2011 Ludwig et al. ..... 366/102
2011/0044567 A1 * 2/2011 Barbaroux et al. ..... 383/120
2011/0158037 A1 * 6/2011 Bernard et al. ..... 366/173.2
2012/0027324 A1 * 2/2012 Morrissey et al. ..... 383/105
2012/0155216 A1 * 6/2012 Morrissey et al. ..... 366/273

* cited by examiner

MIXING IN A CONTAINER OF CONTENT HAVING A BASE COMPONENT AND A COMPONENT TO BE MIXED

BACKGROUND OF THE INVENTION

1. Field of the Invention

The invention relates to the mixing in a container of contents having a base component and a component to be mixed.

The invention more especially relates to a mixing process, a spraying and dispersing device, especially designed for implementing the mixing process, and a mixing device, also especially designed for implementing the mixing process and including such a spraying and dispersing device.

2. Description of the Related Art

A process for mixing contents that are in a container is already known, said process being of the type in which:

On the one hand,

- A container is provided that is equipped with means for introducing components of the contents that should be located therein and to which means for mixing said contents can be connected,
- Components of said contents are provided of which at least one is substantially liquid (this component is conventionally referred to below as "base of the contents") and at least one is designed to be mixed with the base of the contents (this component is conventionally referred to below as "component to be mixed"), Then, on the other hand, the components of the contents are introduced into the container, and the different components that are in the container are mixed.

"Mixing" and "mixture" are defined as the operation and the result of the operation that consists in that several separate components form the same more or less viscous fluid phase or several phases with a high degree of homogenization.

A mixing process as was just described is provided, for example, in the case of biopharmaceutical fluids. It can then be implemented by means of a pocket of the type of the one that is described in the document FR-A-2 781 202.

The document FR-A-2 781 202 actually describes a pocket that is made of plastic material having two large walls and two gussets. Each gusset comprises two small walls that are connected to one another by an inside fold, and each small wall is connected to the large adjacent wall by an outside fold. Such a pocket, once expanded, assumes a three-dimensional shape (cylindrical, prismatic, parallelepipedic . . . ) and can have a volume of 50 liters and even more, which justifies that some call the pocket 3D.

In some cases, the component to be mixed is in substantially solid form, in block or in powder form, while being able to be dissolved in the base of the contents. Typically, such a component to be mixed, in the absence of an external action, can tend to float to the free surface of the base of the contents or to clump. The result is that the dissolution of the component to be mixed and its mixing in the base of the contents are made difficult.

To attempt to overcome this difficulty, it is proposed to initiate a strong, i.e., powerful, mixing operation, which in its turn poses other problems such as the appearance of foam. In addition, in some cases, the contents to be mixed can deteriorate if the mixing that it undergoes is powerful.

In other cases, the component to be mixed is not in solid form but, for example, in the form of a gel that is poorly miscible or even immiscible in the base of the contents. The high degree of homogenization that is then desired is made difficult to obtain.

The document US 2005/279687 describes a pressurized water-gas mixing device, quite especially designed for a multifunctional machine with oxidized water. The device in question comprises a hollow container that has, in the upper part, a water intake, a gas intake, a water-collecting means that is provided on the inside of the hollow container, having lateral perforations that form outlet openings for the nebulized water in the direction of the inside surface of the cylindrical wall of the hollow container. With such a device, the water is introduced via the intake and is collected in the collecting means. It exits from the collecting means by perforations and is sprayed on the inside surface of the cylindrical wall of the container. In its movement, it encounters the gas stream that is introduced into the device via the corresponding intake. Such a device is not designed for the implementation of a mixing process such as the one of this invention. In addition, if it comprises spraying and dispersing perforations, the latter do not allow the sprayed product to reach essentially the entire free surface of the contents of the container, whereby the sprayed product actually reaches the inside surface of the cylindrical wall of the hollow container.

There is therefore a problem when it is desired to mix in a container a base of the contents and a component to be mixed that is solid or immiscible or poorly miscible, when the latter tends to float to the free surface of the base of the contents or to clump, or cannot be mixed with the desired degree of homogenization, or else when the mixing operation is too powerful.

BRIEF SUMMARY OF THE INVENTION

The object of the invention is therefore to remedy these problems.

For this purpose, and according to a first aspect, the purpose of the invention is a process for mixing contents that are in a container, of the type in which:

On the one hand,

- A container is provided that is equipped with means for introducing components of the contents that should be located therein and to which means for mixing said contents can be connected,
- Components of said contents are provided of which at least one is substantially liquid (said at least one substantially liquid component is referred to as base of the contents) and at least one is designed to be mixed with the base of the contents (said at least one component that is designed to be mixed is referred to as component to be mixed), Then, on the other hand, the components of the contents are introduced into the container, and the different components that are found in the container are mixed, characterized by the fact that:

On the one hand,

- A component—mixing facilitator—that is designed to be an integral part of said contents is provided by being mixed with other components of the latter, whereby this mixing facilitator is liquid and has been specially selected for its compatibility with the required qualities of the contents and its capacity for promoting the mixing operation of the component to be mixed in the base of the contents,
- A spraying and dispersing device is provided that can be structurally connected to the container at one of its introduction means (means for introducing the mixing facilitator), whereby said spraying and dispersing device can be in a potentially or actually active functional state in which it is possible to spray and to disperse a liquid into the container, Then, on the other hand, In a first phase, the base of the contents and then the component to be mixed are introduced into the container, without filling the latter, and In a second subsequent separate phase, the spraying and dispersing device then being connected to the means for introducing the mixing facilitator, the mixing facilitator is introduced into the container by said introduction means, and it is sprayed by dispersing it toward the component to be mixed by means of said spraying and dispersing device that is put into the potentially or actually active functional state.

According to one embodiment, a component to be mixed in substantially solid form, in block or in powder form, which, in the absence of an external action, tends to float to the free surface of the base of the contents, is provided, and the mixing facilitator is sprayed and dispersed for wetting the component that is to be mixed and that floats to the surface of the base of the contents, this wetting facilitating the dissolution or the dispersion of the component to be mixed in the base of the contents and their mixing.

According to one embodiment, the mixing facilitator is sprayed by dispersing it in an omnidirectional manner at an aperture angle that can allow the mixing facilitator to reach essentially the entire free surface of the contents of the container and the floating component to be mixed that is located therein, in this embodiment.

According to a first embodiment, a mixing facilitator is provided that is of the same nature as the component or one of the components of the base of the contents. According to a second embodiment, a mixing facilitator is provided that is of a different nature from the components of the base of the contents.

According to one embodiment, in the first phase, the base component is introduced into the container by a suitable introduction means, separate or not from the means for introducing the facilitator, whereas the spraying and dispersing device is structurally connected to the means for introducing the facilitator and is in the functional inactive state.

According to one embodiment, in the first phase, after having introduced the base component into the container, the removable spraying and dispersing device is structurally separated from the means for introducing the facilitator, and then the component to be mixed is introduced into the container by the means for introducing the facilitator.

According to one embodiment, after having introduced the component to be mixed into the container, the spraying and dispersing device is structurally connected to the means for introducing the facilitator, and then the mixing facilitator is introduced into the container by the means for introducing the facilitator.

According to one embodiment, in the second phase, the introduction, the spraying, and the dispersing of the mixing facilitator to the component to be mixed is continued until the time when a portion of the component to be mixed is dissolved or dispersed in the base of the contents.

According to one embodiment, the mixing is begun at the time, or before or after the time, when the introduction of the component to be mixed into the container is begun, and the mixing is continued at least until the time when the entire component to be mixed is dissolved or dispersed into the base of the contents.

According to one embodiment, low to medium mixing is initiated, based on the components of the contents, without the necessity for strong mixing.

According to one embodiment, a closed container is used except in the first phase for the introduction of the component to be mixed into the container.

According to one embodiment, a container is used that is in the form of a plastic foldable pocket with gussets that includes a mixing means. More specifically, according to one embodiment, the starting material is a foldable pocket with gussets in the folded state and, in a preliminary phase, said foldable pocket with gussets is expanded in volume.

According to one embodiment, in a final phase, the container is filled at least substantially with the base of the contents and/or the mixing facilitator, whereas the spraying and dispersing device is connected to the means for introducing the facilitator.

According to a second aspect, the purpose of the invention is a spraying and dispersing device that is especially designed for the implementation of the mixing process that was just described and that includes a wall that is provided, on the one hand, with peripheral means for structurally connecting to a means for introducing a mixing facilitator of a container that has an opening and an axis D, and, on the other hand, spraying and dispersing perforations that are distributed over all—or a substantial portion—of the surface that is designed to be located facing the opening and arranged in an omnidirectional manner at an aperture angle ($\alpha$) around the axis D, able to make it possible for the mixing facilitator (Fm), sprayed and dispersed by said spraying and dispersing device, to reach substantially the entire free surface (S) of the contents of the container, in particular the floating component to be mixed (Cm) that is located therein.

According to a first variant embodiment, the wall is deformable between an essentially flat configuration when said spraying and dispersing device is in the inactive functional state and a curved configuration with a convexity rotated toward the inside of the container when said spraying and dispersing device is in the potentially or actually active functional state, whereby said curved configuration defines said omnidirectional dispersion at said aperture angle, the wall being in its essentially flat configuration in the absence of external stress, in particular for introducing the mixing facilitator, and being responsive to the stress exerted on it by the mixing facilitator during its introduction into the container in such a way as to then be in its curved configuration.

According to one embodiment, the wall is equipped with perforations that, when said spraying and dispersing device is in the inactive functional state, are essentially closed and that, when said spraying and dispersing device is in the potentially or actually active functional state, are open.

According to a second variant embodiment, the wall is analogous to the one that was just described, but rigid and not deformable.

According to another embodiment, the wall is equipped with perforations that are always open, in particular when said spraying and dispersing device is in the inactive functional state.

According to a first embodiment, the perforations of one wall are identical to one another. According to a second embodiment, the perforations are differentiated from one another by their size and/or their shape according to their position on the wall so as to perform their function as well as possible.

According to a first variant embodiment, the peripheral means for structurally connecting to a means for introducing the mixing facilitator of a container come in the form of an annular bead that is able to work in a removable manner with means that are complementary to the means for introducing the mixing facilitator that has the form of an annular hollow that is made in the means for introducing the mixing facilitator.

According to a second variant embodiment, the peripheral means for structurally connecting to a means for introducing the mixing facilitator of a container consist of the wall that is formed by an elastically deformable piece that is able—by the tension that is exerted thereon—to be expanded and then slipped onto the collar around which it can then fit tightly and on which it is held in a removable manner.

According to a third aspect, the purpose of the invention is a mixing device that is especially designed for the implementation of the mixing process that is described above, comprising:

- A container that is equipped with means for introducing components of the contents that it is designed to receive, including a means for introducing the mixing facilitator that is located on its upper wall and in the form of an opening, whereby the means for introducing the mixing facilitator and the opening have an axis D,
- Means for mixing said contents, connected to the container, and
- A spraying and dispersing device that comprises a wall that is equipped, on the one hand, with peripheral means for structurally connecting to the means for introducing the mixing facilitator, and, on the other hand, spraying and dispersing perforations that are distributed over the entire surface or a substantial portion of the surface that is designed to be located facing the opening and arranged in an omnidirectional manner at an aperture angle ($\alpha$) around the axis D, able to allow the mixing facilitator (Fm) that is sprayed and dispersed by said spraying and dispersing device to reach essentially the entire free surface (S) of the contents of the container, in particular the floating component to be mixed (Cm) that is located therein.

According to one embodiment, the container is closed, except when the means for introducing the mixing facilitator is open.

According to one embodiment, the container is a plastic foldable pocket with gussets that includes the mixing means.

According to one embodiment, the means for introducing the mixing facilitator comes in the form of an opening that is formed by a peripheral collar that is adjacent to the container, a cap with a port for introducing liquid being mounted on the collar, whereby the spraying and dispersing device is structurally connected, in a removable manner, to the means for introducing the mixing facilitator by its structurally connected peripheral means working with means that are complementary to the means for introducing the mixing facilitator.

BRIEF DESCRIPTION OF THE DRAWINGS

Several embodiments of the invention are now described using drawings in which.

DETAILED DESCRIPTION OF THE PREFERRED EMBODIMENTS

A mixing device 1 that is especially designed for the implementation of the mixing process disclosed above first of all comprises a container 2.

Figures 1A, 1B, 1C, 1D:
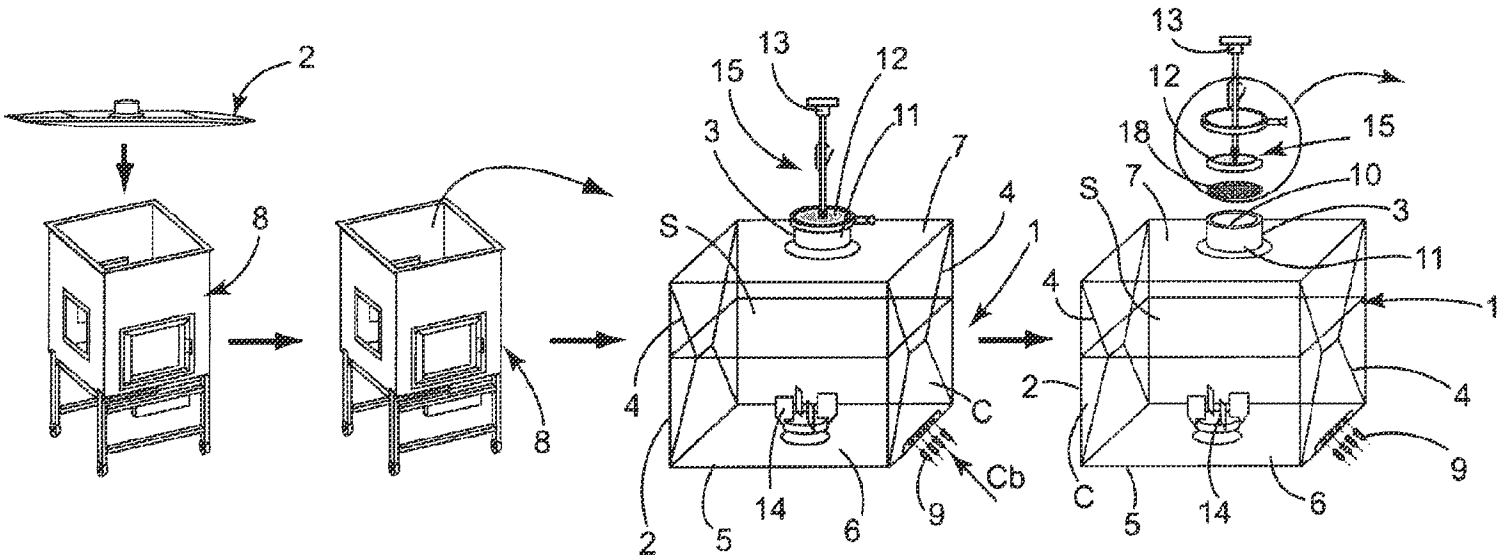
FIG. 1 is a diagrammatic view of the mixing process according to the invention; it comprises eight perspective diagrams, or FIG. 1A, FIG. 1B, FIG. 1C, FIG. 1D, FIG. 1E, FIG. 1F, FIG. 1G and FIG. 1H, corresponding to successive stages of the process, whereby the first is shown by FIG. 1A and the last by FIG. 1H.
Figures 1E, 1F, 1G, 1H:
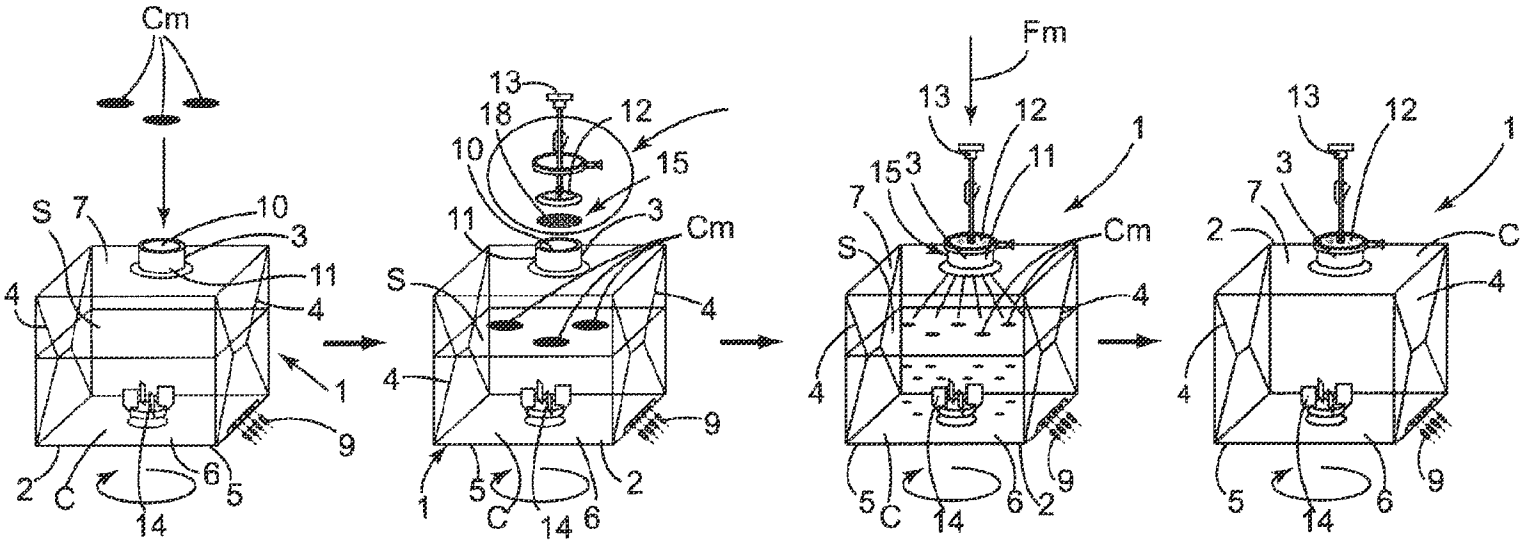
Figure 2:
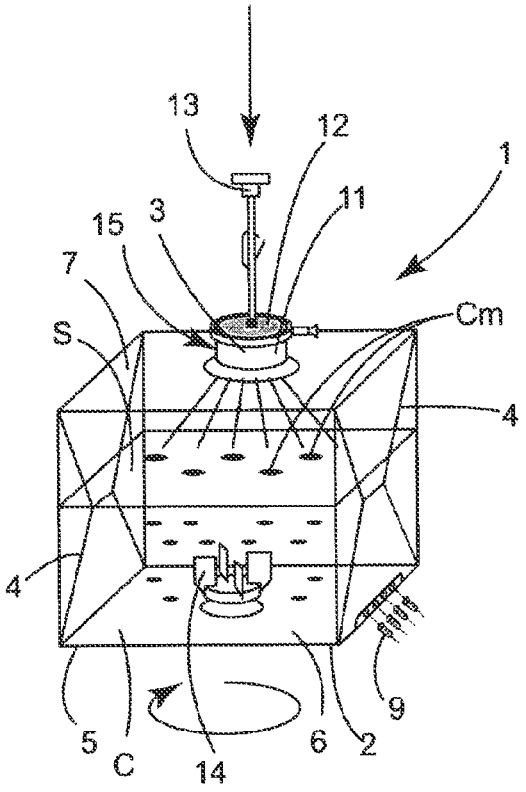
FIG. 2 is a diagrammatic perspective view that corresponds to FIG. 1G on a larger scale.

In the embodiment that is shown, the container 2 is closed except when a certain means of introduction 3 with which it is equipped and which will be referenced again is open (FIGS. 1D and 1E).

In the embodiment that is shown, the container 2 is a plastic flexible pocket that can be folded by means of gussets 4. Such a pocket is, for example, a so-called 3D pocket of the general type that is described in the document FR-A-2 781 202.

Such a pocket 2 can have a volume that exceeds 50 l and reaches 3,000 l, which justifies its being able to be termed a "large" pocket.

When it is deployed and expanded in volume, such a pocket 2 has a generally parallelepipedic shape with a bottom wall 5 that is arranged essentially horizontally, four side walls 6 that are arranged essentially vertically, and an upper wall 7 that is arranged essentially horizontally.

Such a pocket 2 is designed to be used in connection with a resistant rigid container 8 into which it is placed in a removable manner.

It is understood that the invention applies to other types of containers 2. It may involve in particular rigid containers that are permanently open and that are made of metal, with different capacities.

The container 2 is equipped with means of introduction into the volume that it defines of the components Co of the contents C that it is designed to receive, able to make it possible to introduce these components into this space in the desired quantity. Actually, these components Co, before being introduced into the container 2, are packaged in means that are provided for this purpose: tanks, drums, pockets . . . .

In this case, it is provided that the container 2 is equipped with an introduction means 3 termed "means for introducing the mixing facilitator."

It is also provided that the container 2 is equipped with an introduction means 9 that is able to make possible the introduction of a component with a liquid composition or, optionally, a more or less viscous composition.

This introduction means 9 is different from the introduction means 3 or is the same.

If necessary, the container 2 comprises a larger number of such introduction means 3, 9.

In the embodiment that is shown in the drawings, the introduction means 3 is located on the upper wall 7 and the other introduction means 9, separate, is located elsewhere, for example toward the junction between the bottom 5 and one of the side walls 6.

In the embodiment shown in the drawings, the means 3 for introducing the mixing facilitator comes in the form of an opening 10 that is formed and delimited by a peripheral collar 11 that is adjacent to the upper wall 7 of the container and directed toward the outside of the latter. The opening is wide enough here to make possible the introduction of one or more components that are of solid and more or less bulky form.

A cap 12 that is provided with a port 13 for introducing liquid is mounted on the collar 11, in a removable manner, owing to removable attachment means that are provided for this purpose.

The port 13 can have an identical structure, analogous or close to that of the corresponding port of the introduction means 9. This port 13 is therefore able to allow the introduction of a component with a liquid or, optionally, more or less pasty composition.

Thus, the introduction means 3 is polyvalent. When the cap 13 is mounted on the collar, it makes possible the introduction of a component of a liquid or, optionally, more or less pasty composition. When the cap 13 is removed from the collar, it makes possible the introduction of a component of solid and more or less bulky composition.

In one embodiment, the removable attachment means of the cap 12 on the collar 11 are separate from the cap 12 and are connected to it, such as attachment collars. This embodiment does not exclude others.

Next, the mixing device 1 comprises means 14 for mixing the contents C of the container 2, connected to container 2.

Such mixing means 14, by themselves, are known or are within the scope of one skilled in the art. It may be a matter of, for example, a mixing propeller that is mounted in the container on the bottom 5, driven by suitable motor means.

Finally, the mixing device 1 comprises a spraying and dispersing device 15.

The spraying and dispersing device 15 is able to be structurally connected to the container 2, namely with the means 3 for introducing the mixing facilitator.

More specifically, the spraying and dispersing device 15 is structurally connected to the means 3 for introducing the mixing facilitator, in a removable manner, by structurally connected peripheral means 16 with which it is equipped, arranged to work with complementary means 17 with which the means 3 for introducing the mixing facilitator is equipped.

Figure 3:
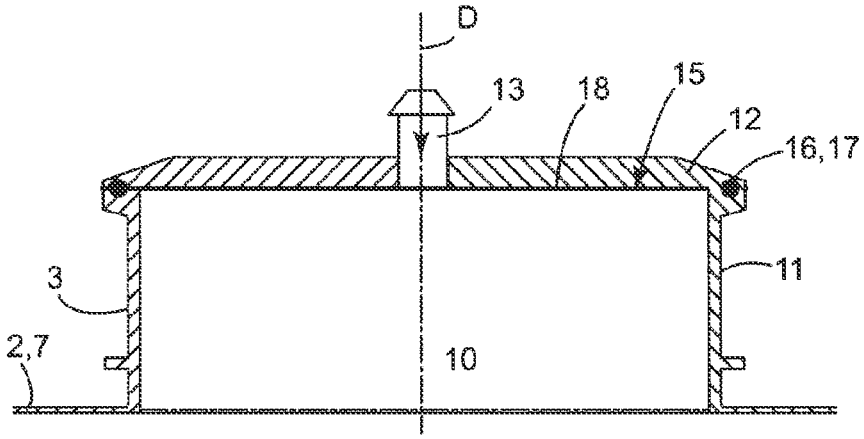
FIG. 3 is a diagrammatic view in cross-section of the means for introducing the mixing facilitator that forms part of a mixing device to which a spraying and dispersing device is connected, according to a first variant, found in its inactive functional state.
Figure 4:
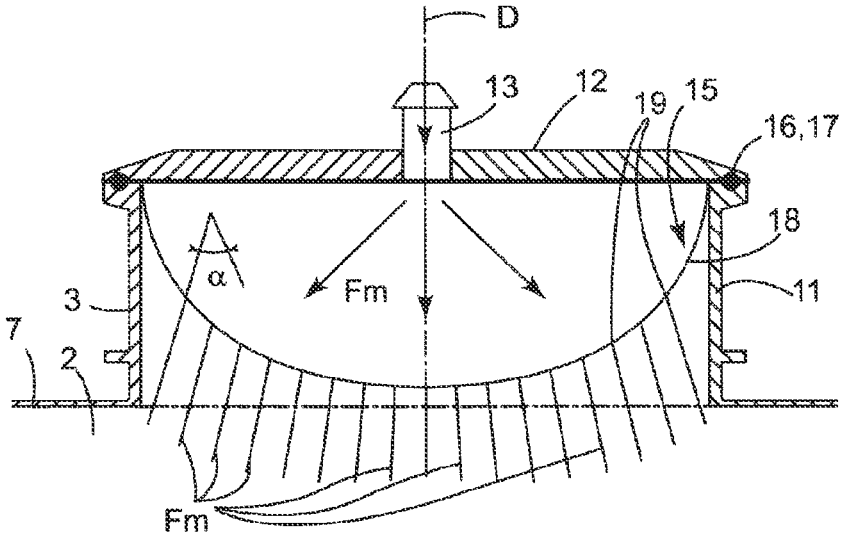
FIG. 4 is a diagrammatic view that is analogous to FIG. 3, whereby the spraying and dispersing device according to the first variant is in its active functional state.
Figure 5:
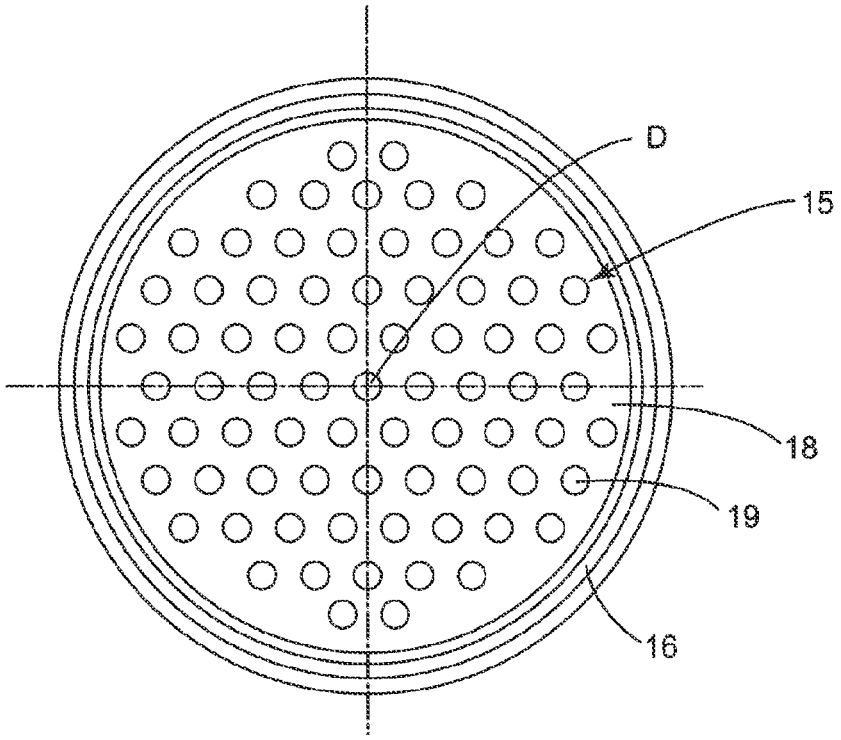
FIG. 5 is a diagrammatic elevation view of the spraying and dispersing device according to the first variant that is in its active functional state.

In the embodiment shown in FIGS. 3 to 5 corresponding to a first variant, the structurally connected peripheral means 16 come in the form of an annular bead that can work, in a removable manner, with the complementary means 17 with which the means 3 for introducing the mixing facilitator is equipped, in this case an annular hollow that is made in the means 3 for introducing the mixing facilitator, in particular between the collar 11 and the cap 12.

Figure 6:
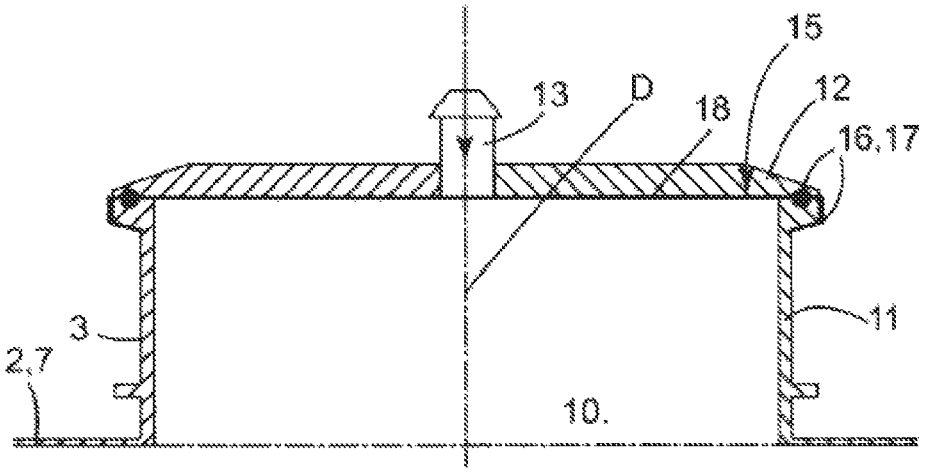
FIG. 6 is a diagrammatic, transverse cutaway view of the means for introducing the mixing facilitator that is part of a mixing device to which is connected a spraying and dispersing device, according to a second variant that is in its inactive functional state.

According to another embodiment that is shown in FIG. 6 corresponding to a second variant, the structurally connected peripheral means 16 consist of the wall 18 that is formed by an elastically deformable piece that can, by the tension that is exerted on it, be expanded and then slipped onto the collar 11 around which it can then fit tightly and on which it is held in a removable manner.

The spraying and dispersing device 15 comprises a wall 18 that is equipped on its periphery with structurally connected means 16, in particular the bead of which mention was made above.

This wall 18 is equipped with spraying and dispersing perforations 19, distributed over all—or a substantial portion—of the surface that is designed to be located facing the opening 10.

If appropriate, the perforations 19 of a wall 18 are identical to one another or, on the contrary, are differentiated from one another by their size and/or their shape according to their position on the wall 18 so as to perform their function as well as possible.

D is defined as the axis—generally arranged vertically—of the opening 10 and the means 3 for introducing the mixing facilitator.

The wall 18 is equipped with spraying and dispersing perforations 19 that are arranged in an omnidirectional manner at an aperture angle $\alpha$, around the axis D, in such a way as to allow the mixing facilitator Fm, which is sprayed and dispersed by the spraying and dispersing device 15, to reach essentially the entire free surface S of the contents of the container 2, and, as will be seen below in the embodiment whose purpose is more especially a component to be mixed Cm in solid form, said component to be mixed Cm is located at this free surface S and floats therein.

In a first variant embodiment shown in the figures, the wall 18, made of, for example, a material such as silicone, is deformable between an essentially flat configuration (FIG. 3) and a curved configuration with convexity rotated toward the inside of the container 2 and concavity rotated toward the cap 12 and the port 13 (FIG. 4).

The spraying and dispersing device 15 is either connected to the container 2, namely to its means 3 for introducing the mixing facilitator, or separated from it. When it is connected, it is, when this is necessary, in a potentially or actually active functional state in which it makes it possible to spray and to disperse a liquid that is introduced by the port 13 into the container 2. When a liquid that is introduced by the port 13 into the container 2 is not sprayed and dispersed, the spraying and dispersing device 15 is either in this same potentially or actually active functional state or in an inactive functional state in which the means 3 for introducing the mixing facilitator is, for example, closed.

The wall 18 is essentially flat in its configuration (FIG. 3) when the spraying and dispersing device 15 is in the inactive functional state. It is in its curved configuration (FIG. 4) when the spraying and dispersing device 15 is in the potentially or actually active functional state.

The wall 18 is in its essentially flat configuration in the absence of external stress, in particular for introducing a liquid through the port 13. It is responsive to the stress exerted on it by such a liquid that is introduced into the container through the port 13 and then assumes, under the action of the pressure exerted by the liquid in question, the curved configuration.

In the embodiment in question, when the spraying and dispersing device 15 is in the inactive functional state, the perforations 19 are essentially closed, whereas they are open when the spraying and dispersing device 15 is in the active functional state.

The embodiment of the spraying and dispersing device 15 that was just described does not exclude others of a different nature or structure that perform the same function and obtain identical or analogous results. Thus, according to a second variant embodiment, the wall 18 is analogous to the one that was described above, but it is rigid and not deformable. Such a rigid wall 18 can be either flat or curved as it was just described. Also, according to another embodiment, the wall 18, deformable or rigid, is provided with perforations 19 that are always open, in particular when said spraying and dispersing device 15 is in the inactive functional state.

The purpose of the process according to the invention is to ensure the mixing of the contents C that are in the container 2.

This container C comprises several separate components Co that are mixed in the container 2, owing to the mixing device 1 that was just described, in particular owing to the spraying and dispersing device 15.

One of the components Co is substantially liquid. This means that it is totally in liquid form or that it has a more or less pasty form. As indicated above, this component is conventionally referred to below as "base of the contents" Cb.

One of the components Co is designed to be mixed with the base of the contents Cb. As indicated above, this component is conventionally referred to below as "component to be mixed" Cm.

It is understood that the number of these components is not limited to two. Several components that form the base of the contents Cb and/or several components that form the component to be mixed Cm can be provided.

In the application that is more especially described here, the component to be mixed Cm has a substantially solid shape, being either in block form or in powder form. This component is able, if it is miscible with the base of the contents Cb, to be dissolved in it, or if it is not miscible with it, to nevertheless be dispersed in it with a high degree of homogenization.

According to another embodiment, the component to be mixed Cm has a fluid form, and it is not miscible in the base of the contents Cb. It involves, for example, a gel, suspended in the base of the contents Cb.

More especially, the main advantage of the invention lies in the case of a component to be mixed Cm in substantially solid form that, in the absence of external action, tends to float to the free surface S of the base of the contents Cb.

One of the components Co is designed to be an integral part of the contents C by being mixed with other components Cb and Cm of the latter. This component is liquid, and it has been specially selected for its compatibility with the required qualities of the contents C and its capacity for promoting the mixing operation of the component to be mixed Cm in the base of the contents Cb. This component is conventionally referred to as "mixing facilitator."

If appropriate, the mixing facilitator Fm has the same nature as the base of the contents Cb or, on the contrary, a different nature. In one embodiment, the mixing facilitator Fm is water.

In a first phase of the process (FIGS. 1C to 1F), the base of the contents Cb and then the component to be mixed Cm are introduced into the container 2, without totally filling the latter.

To the extent that a start is made from a foldable pocket 2 with gussets that is initially in the folded state, the process comprises a preliminary phase in which said foldable pocket with gussets is expanded in volume, and it is placed in the resistant container 8 (FIGS. 1A and 1B). Such operations are known in the art or are within the scope of one skilled in the art.

In this situation, and in the first phase, the spraying and dispersing device 15 is structurally connected to the means 3 for introducing the mixing facilitator by making the respective means 16 and 17 work together.

The spraying and dispersing device 15 is then in the inactive functional state.

In this situation, the base component Cb is introduced into the container 2 by the suitable introduction means 9 that is provided for this purpose, separate or not from the means 3 for introducing the mixing facilitator.

As indicated, the base component Cb does not totally fill the container 2, and it has a free surface S.

The operation that was just described is illustrated by FIG. 1C.

In the same first phase, after having introduced into the container 2 the base component Cb, the spraying and dispersing device 15 is structurally separated from the means 3 for introducing the mixing facilitator.

To do this, the cap 12 is removed, the spraying and dispersing device 15 is removed, and the opening 10 is left open.

The operation that was just described is illustrated by FIG. 1D.

In this situation, the component to be mixed Cm is introduced into the container 2 by the means 3 for introducing the mixing facilitator, more specifically by the opening 10. This is possible even for a component to be mixed that is in solid form because of the adequate size given to the opening 10.

As indicated, the component to be mixed Cm, in solid form, may have a tendency to float to the free surface S of the base of the contents Cb.

The operation that was just described is illustrated by FIG. 1E.

In a second separate and subsequent phase, the spraying and dispersing device 15 is again connected to the means 3 for introducing the mixing facilitator by making the respective means 16 and 17 work together.

In this situation, the mixing facilitator Fm is introduced into the container 2 by the introduction means 3 that are provided for this purpose.

Owing to the presence of the spraying and dispersing device 15, then put into the active functional state, the wall 18 that was in its essentially flat configuration is placed in its curved configuration under the action of the stress exerted on it by the mixing facilitator that is introduced through the port 13.

By so doing, the mixing facilitator is sprayed by dispersing it toward the base of the contents Cb and toward the component to be mixed Cm.

The mixing facilitator Fm is sprayed and dispersed as it was just indicated to wet the component to be mixed Cm, which floats to the free surface S of the base of the contents Cm.

It is this wetting that facilitates the dissolution or the dispersion of the component to be mixed Cm in the base of the contents Cb and their respective mixing.

As it results from the preceding description, the mixing facilitator Fm is sprayed by dispersing it in an omnidirectional manner at an aperture angle $\alpha$ in such a way that the mixing facilitator Fm essentially reaches the entire free surface S of the contents of the container 2 and the floating component to be mixed Cm that is located therein, in this variant embodiment.

In this second phase, the introduction, the spraying and the dispersing of the mixing facilitator Fm toward the component to be mixed Cm is continued until the time when a portion of the component to be mixed Cm is dissolved or sufficiently dispersed in the base of the contents Cb. In general, it is not essential to continue the spraying and the dispersing of the mixing facilitator Fm until the entire component to be mixed Cm is dissolved or dispersed in the base of the contents Cb.

The operation that was just described is illustrated by FIG. 1G.

The mixing of the contents of the container 2 is implemented using mixing means 14.

The mixing is begun at the time, or, most often before the time, but also possibly after the time, when the introduction of the component to be mixed Cm into the container is begun (FIG. 1E), and the mixing is continued at least until the time when the entire component to be mixed is dissolved or dispersed in the base of the contents (FIG. 1H). This time is generally after the one where the introduction, the spraying and the dispersing of the mixing facilitator Fm toward the component to be mixed Cm is completed.

The invention allows the initiation of mixing of low to medium power, and this is based on the components Cb, Cm of the contents. It is not essential to have recourse to a mixing of high power, with the advantages that are derived therefrom.

The process also comprises a final phase in which the container 2 is filled at least substantially with the base of the contents Cb and/or the mixing facilitator Fm, whereas the spraying and dispersing device is connected to the means 3 for introducing the mixing facilitator.

The operation that was just described is illustrated by FIG. 1H.

The invention claimed is:

1. A process for mixing contents that are in a container including means for introducing components of the contents configured to be located therein and means for mixing said contents configured to be connected to the container, the method comprising:

in a first phase, introducing components of said contents into the container, at least one of the contents being substantially liquid, the at least one substantially liquid content being a base of the contents, and at least one other of the contents being configured to be mixed with the base of the contents, the other of the contents being a component to be mixed, the at least one substantially liquid content including a mixing facilitator that is an integral part of the contents, the mixing facilitator being liquid and being selected for compatibility of the mixing facilitator with required qualities of the contents and for a capacity of the mixing facilitator to promote a mixing operation of the components to be mixed in the base of the contents, the introducing the components including introducing the base of the contents into the container, and subsequently introducing the component to be mixed into the container, without filling the container;

in a second subsequent separate phase from the first phase, introducing the mixing facilitator into the container by one of one or more mixing facilitator introduction means for introducing the mixing facilitator, the mixing facilitator introduction means being connected to a spraying and dispersing device that is structurally connected to the container at the one or more mixing facilitator introduction means, the spraying and dispersing device being configured to enter into an active functional state in which a liquid is sprayed and dispersed into the container, and spraying the mixing facilitator by dispersing the mixing facilitator toward the component to be mixed by the spraying and dispersing device that is put into the active functional state, wherein the different components that are in the container are capable of being mixed.

2. The mixing process according to claim 1, wherein the component to be mixed is provided either in fluid form that is immiscible or poorly miscible in the base of the contents or in a substantially solid form, in block or in powder form, able to be dissolved or dispersed with a high degree of homogenization in the base of the contents.

3. The mixing process according to claim 2, wherein when the component to be mixed is provided in substantially solid form, in block or in powder form, in the absence of external action, the component provided in substantially solid, block, or powder form tends to float to the free surface of the base of the contents, and the mixing facilitator is sprayed and dispersed to wet the component to be mixed that floats to the surface of the base of the contents, wetting the component to be mixed facilitating the dissolution or the dispersion of the component to be mixed in the base of the contents and a mixture including the base of the contents.

4. The mixing process according to claim 3, wherein the mixing facilitator is sprayed by dispersing the mixing facilitator in an omnidirectional manner at an aperture angle such that the mixing facilitator is configured to reach the entire free surface of the contents of the container and the floating component to be mixed that is located therein.

5. A mixing device configured to implement the mixing process according to claim 3, comprising:

the container that is equipped with the means for introducing components of the contents that the container is configured to receive, the container including an opening that is located on an upper wall of the container, the opening having an axis;

the means for mixing the contents being connected to the container; and the spraying and dispersing device having a wall including a peripherally-disposed structural connection device configured to be structurally connect to the mixing facilitator introduction means, and spraying and dispersing perforations that are distributed over the entire surface or a substantial portion of the surface that is configured to face the opening and configured in an omnidirectional manner at an aperture angle around the axis such that the mixing facilitator that is sprayed and dispersed by said spraying and dispersing device is configured to reach essentially the entire free surface of the contents of the container the mixing facilitator being able to reach the floating component to be mixed that is located in the container.

6. The mixing device according to claim 5, wherein the container is closed except when the mixing facilitator introduction means is open and/or is a plastic foldable pocket with gussets including the means for mixing.

7. The mixing device according to claim 5, wherein the mixing facilitator introduction means comprises an opening that is formed by a peripheral collar that is adjacent to the container, a cap with a port configured to introduce liquid that is mounted on the collar, the spraying and dispersing device being structurally connected, in a removable manner, to the mixing facilitator introduction means by the structural connection device working with a means for cooperating with the mixing facilitator introduction means that is complementary to the mixing facilitator introduction means facilitator.

8. The mixing process according to claim 1, wherein the mixing facilitator has either a same nature as the components of the base of the contents or has a different nature as the components of the base of the contents.

9. The mixing process according to claim 1, wherein in the first phase, the base component is introduced into the container by the means for introducing the components, the means for introducing the components being one of incorporated into the mixing facilitator introduction means and separate from the mixing facilitator introduction means, and in the first phase, the spraying and dispersing device is structurally connected to the mixing facilitator introduction means and is in an inactive functional state.

10. The mixing process according to claim 9, wherein in the first phase, after having introduced the base component into the container, the spraying and dispersing device, which is removable, is separated structurally from the mixing facilitator introduction means, and then the component to be mixed is introduced into the container by the mixing facilitator introduction means.

11. The mixing process according to claim 10, wherein after having introduced the component to be mixed into the container, the spraying and dispersing device is structurally connected to the mixing facilitator introduction means, and then the mixing facilitator is introduced into the container by the mixing facilitator introduction means.

12. The mixing process according to claim 1, wherein in the second phase, the introducing, the spraying, and the dispersing of the mixing facilitator toward the component to be mixed is continued until a time when a portion of the component to be mixed is dissolved or dispersed in the base of the contents.

13. The mixing process according to claim 1, wherein the mixing is initiated at an initial time, or before or after the time, when the introducing the component to be mixed into the container is initiated, and the mixing is continued at least until a dissolution or dispersal time when all of the component to be mixed is dissolved or dispersed in the base of the contents.

14. The mixing process according to claim 1, wherein a first level of mixing is initiated based on the components of the contents, without initiating mixing at a second level of mixing that is greater than the first level of mixing.

15. The mixing process according to claim 1, wherein the container is closed, except in the first phase for introducing the component to be mixed into the container, or the container is a plastic foldable pocket with gussets including the means for mixing.

16. The mixing process according to claim 1, further comprising:

in a final phase, filling the container at least substantially with the base of the contents and/or the mixing facilitator, the spraying and dispersing device being connected to the mixing facilitator introduction means.

17. A spraying and dispersing device configured to implement the mixing process according to claim 1, the spraying and dispersing device comprising:

a wall that is provided with a peripherally-disposed structural connection device configured to be structurally connected to the mixing facilitator introduction means of the container that has an opening and an axis, and spraying and dispersing perforations that are distributed over all, or a substantial portion, of the surface that is configured to face the opening and configured in an omnidirectional manner at an aperture angle around the axis such that the mixing facilitator that is sprayed and dispersed by said spraying and dispersing device is configured to reach substantially the entire free surface of the contents of the container, the mixing facilitator being able to reach a floating component to be mixed that is located in the container.

18. The spraying and dispersing device according to claim 17, wherein the wall is deformable between an essentially flat configuration when said spraying and dispersing device is in an inactive functional state and a curved configuration with a convexity rotated toward the inside of the container when said spraying and dispersing device is in the active functional state, the curved configuration defining an omnidirectional dispersion at said aperture angle in the introducing of the mixing facilitator, the wall having the essentially flat configuration in the absence of external stress and being responsive to the stress exerted on the wall by the mixing facilitator during introduction of the mixing facilitator into the container to then have the curved configuration.

19. The spraying and dispersing device according to claim 18, wherein the perforations at the wall are essentially closed when said spraying and dispersing device is in the inactive functional state, and are open when said spraying and dispersing device is in the active functional state.

20. The spraying and dispersing device according to claim 17, wherein the wall is rigid.

21. The spraying and dispersing device according to claim 17, wherein the perforations at the wall are always open when said spraying and dispersing device is in an inactive functional state.

22. The spraying and dispersing device according to claim 17, wherein the perforations are either identical or are differentiated by size and/or shape according to respective positions of the perforations on the wall.

23. The spraying and dispersing device according to claim 17, wherein the peripherally-disposed structural connection device that is configured to structurally connect to the mixing facilitator introduction means of the container comprises an annular bead that can cooperate, in a removable manner, with an annular hollow formed in the mixing facilitator introduction means, the annular hollow being complementary to the mixing facilitator introduction means.

24. The spraying and dispersing device according to claim 17, wherein the peripherally-disposed structural connection device consists of the wall that is formed by an elastically deformable piece that is configured, by the tension that is exerted thereon, to be expanded and then slipped onto a collar around which the piece is fit tightly and on which the piece is held in a removable manner.

* * * * *